United States Patent [19]

Grelle

[11] 3,965,496

[45] June 29, 1976

[54] PORTABLE BABY BATHING AND SHAMPOOING TRAY

[76] Inventor: Georgia I. Grelle, 211 Vista Ave., Round Rock, Tex. 78664

[22] Filed: Dec. 9, 1970

[21] Appl. No.: 96,528

[52] U.S. Cl. ..... 4/185 B
[51] Int. Cl.[2] ..... A47K 3/12
[58] Field of Search ..... 4/185 B, 159, 145, 146, 4/185 F

[56] References Cited

UNITED STATES PATENTS

| | | | |
|---|---|---|---|
| 485,743 | 11/1892 | Huss | 4/189 |
| 1,512,068 | 10/1924 | Thornburg | 4/185 B |
| 1,663,609 | 3/1928 | Peabody | 4/185 B |
| 2,531,724 | 11/1950 | Cevasco | 4/185 B |
| 2,548,301 | 4/1951 | Gibson | 4/159 |
| 2,809,380 | 10/1957 | Gruen | 4/173 |
| 2,876,459 | 3/1959 | Ackerson | 4/185 B |
| 3,162,864 | 12/1964 | Ouellette | 4/185 B |
| D188,838 | 9/1960 | Johnson | 4/185 B |

FOREIGN PATENTS OR APPLICATIONS

| | | | |
|---|---|---|---|
| 1,035,381 | 4/1953 | France | 4/145 |

*Primary Examiner*—Peter Feldman
*Assistant Examiner*—Donald B. Massenberg
*Attorney, Agent, or Firm*—Richards, Harris and Medlock

[57] ABSTRACT

A light portable baby bathing and shampooing tray adapted to rest on a flat surface and provide safe, non-slip support for said infant during bathing and shampooing with separate drainage basin provisions for the body and head so that said infant may be bathed with minimum discomfort and struggle, minimum danger of getting soap or shampoo solution in the baby's eyes and with minimum water requirements.

1 Claim, 4 Drawing Figures

FIG. 2
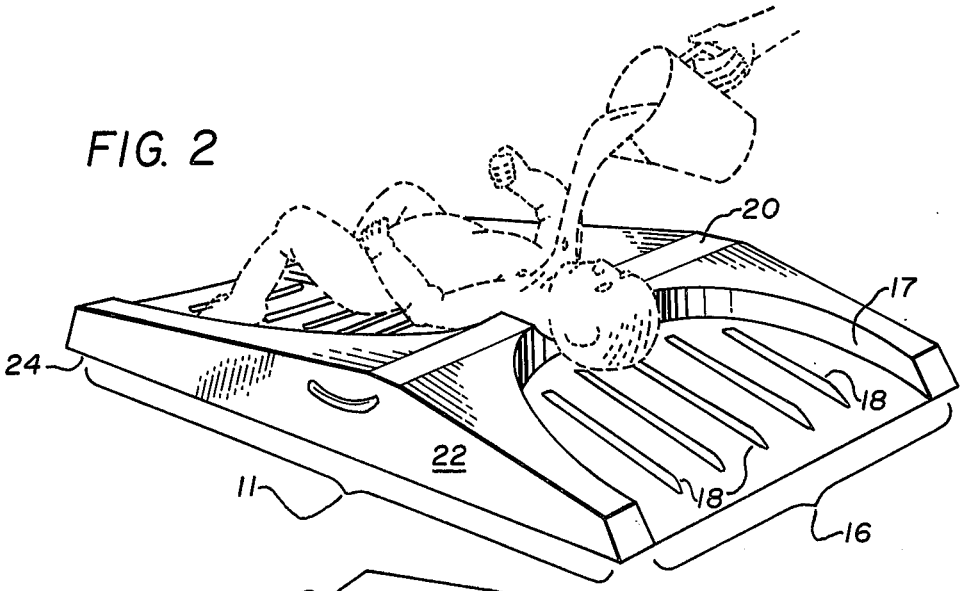
FIG. 1
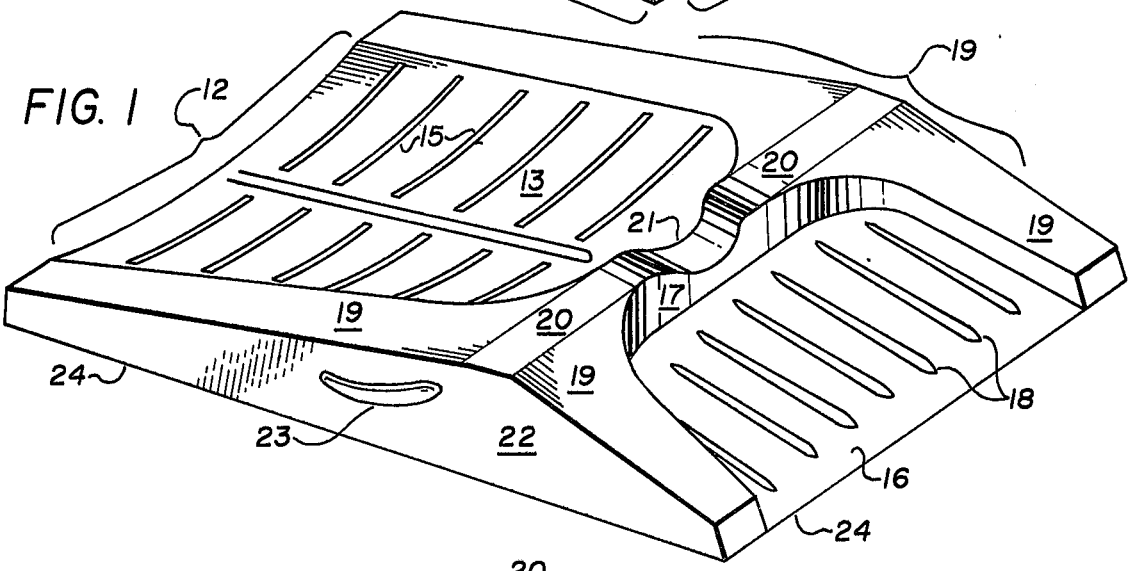
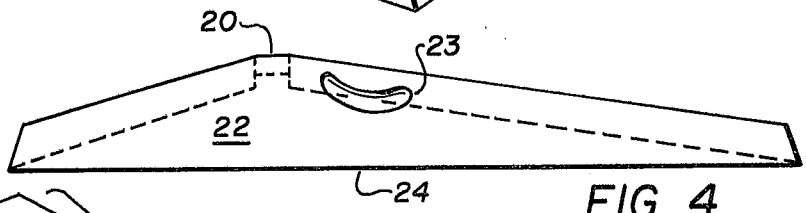
FIG. 4
FIG. 3
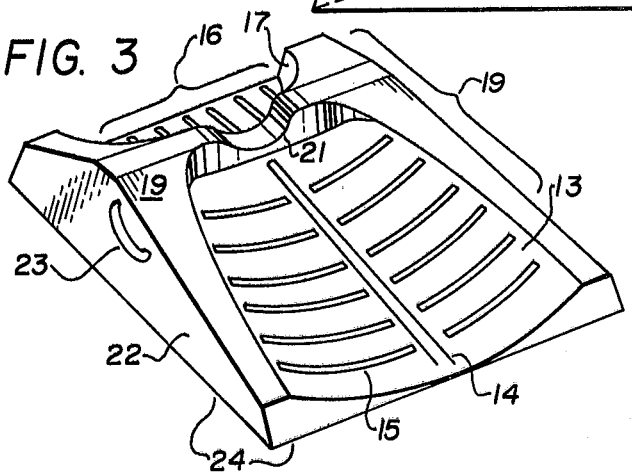
GEORGIA I. GRELLE
INVENTOR.
BY Marion E. Shafer
ATTORNEY

PORTABLE BABY BATHING AND SHAMPOOING TRAY

SUBJECT MATTER OF INVENTION

This invention relates generally to bathing facilities and more particularly relates to special tray means for supporting an infant during the bathing and shampooing operation.

BACKGROUND OF THE INVENTION

Baby bathing facilities are usually awkward to use and parental fears of injuring a child in a hard bathtub or sink precipitate nervousness and faltering efforts that communicate fear to the child and produce further struggle and difficulty with the bathing process. A wide variety of special bathing facilities for babies have been fabricated for the commercial market but most of these have tended to take the form of miniature bath tubs with only moderate modification for the special bathing needs of the infant. Moreover all of these special facilities tend to require considerable amounts of space and do not lend themselves readily to the needs of the automobile travelling age.

In recent years young families have a much greater tendency to travel more frequently and move considerable distances by automobile even when they have one or more small children. At the same time there has been a marked tendency in recent years to create and use plastic trays in which infants can be strapped for quick, safe and convenient portability and to provide for safe support of the infant while traveling in an automobile. Babies seem to have readily accepted the tray carrying arrangement and appear to like the security of such trays. It would therefore logically follow that a tray for infant bathing that is more nearly analagous to the familiar infant carrying tray would be effective in reducing infant struggles against the bathing process.

OBJECTS OF THE INVENTION

One of the difficulties of bathing a baby in a tub or vessel of water is that as soon as the baby is emersed in a container capable of containing water that its back and bottom become difficult to reach and rinse and inaccessible parts of the body may fail to be adequately washed. It is therefore a primary object of this Invention to securely lay the baby out on an open and nearly flat surface where all parts of the baby will be readily accessible for bathing.

A primary object of the Invention is to provide a baby bathing support tray that comfortably and securely supports the child in an open accessible position for more efficient soaping, sponging and rinsing and in such circumstances and convenience as to leave both hands available for the bathing process and thereby make the bathing process more enjoyable for both the baby and the mother.

An object of the Invention is to produce a bathing tray provided with contoured body receiving basins and non-slip friction providing strips and of such structural arrangement as to reduce to a very minimum the danger of an infant being able to roll or slip off of said bathing tray thereby improving the mutual confidence and comfort of the mother and the baby.

Another object of the Invention is to fabricate such improved baby bathing and shampooing tray from a semi-soft or flexible form of plastic material that will minimize the danger of injury to the baby by accidental impact with parts of the tray.

Still another object of the Invention contemplates bathing the baby in such position and circumstances that soap and shampoo solutions are drained away from the baby's face in opposite directions thereby reducing the danger of getting soap into the baby's eyes.

Still another object of the Invention is to provide an effective baby bathing device in the form of a nearly flat unitary tray of sufficient compactness that it will be convenient to handle, store and use in a crowded apartment and in an automobile by auto travelling families.

A further object of the Invention is to provide a baby bathing device that is so nearly analogous in structure to the already familiar baby carrying tray that the baby readily accepts it as a familiar environmental setting for the bathing process.

A still further object of the Invention is to devise a light weight compact and highly portable baby bathing tray that may be used on any convenient substantially flat surface such as a table, a sink drain board, the hood or trunk of an automobile or even on the open ground and that requires the application of such a small amount of water that campers or auto travellers can bathe a baby in the open with a single gallon container of water without requiring access to conventional plumbing and water facilities. The Invention contemplates a device of such compact portability and efficiency that it can be stored in a suit case and used in a bus or airplane rest room, if needed.

These and other objects and advantages of this Invention will become apparent through consideration of the following description and appended claims in conjunction with the attached drawings in which:

DESCRIPTION OF THE SEVERAL VIEWS IN THE DRAWINGS

FIG. 1 is a perspective view of the improved baby bathing and shampooing tray contemplated by this Invention.

FIG. 2 is a perspective view of said Invention in use showing the manner in which a baby can be bathed in the open or at a camp site with a single pitcher of water and showing in detail the head drain ramp.

FIG. 3 is a perspective view of the device showing details of the body drain basin end of the device.

FIG. 4 is a side plan view of said baby bathing and shampoo tray showing positioning of the hand hold means.

In describing one selected form or preferred embodiment of this Invention as shown in the drawings and described in this specification, specific terms and components are used for clarity. However, it is not intended to limit the claimed Invention to the specific form, components or construction shown and it is to be understood that the specific terms used in this illustration of the Invention are intended to include all technical equivalents which operate in a similar manner to accomplish a similar purpose.

DETAILED DESCRIPTION OF PREFERRED EMBODIMENT OF INVENTION

Referring to the specific embodiment of the Invention selected for illustration in the accompanying drawings, the number 11 refers to complete overall baby bathing and shampooing tray. Said tray 11 is preferably of molded unitary construction starting from a base perimeter 24 adapted to rest on any suitable or convenient flat or substantially flat surface. Tray 11 may range from approximately four to seven inches in height or thickness, have a width of slightly over a foot and a length at least one and one-half times greater than the width. Nearly two-thirds of this length is employed as a body supporting and drainage ramp 12 and slightly less than one-third of such length is employed as a head supporting and drainage ramp 16 with the two longitudinally positioned ramps being spaced apart by a distance of one and one-half to three inches creating a transverse ridge 20 between the drainage ramps at an intermediate point in the length of the tray.

Said body supporting and drainage ramp 12 is longitudinally positioned with respect to the overall length of tray 11 and is inclined upwardly from one end where its outside open lower extremity merges with part of base perimeter 24 to an elevated ridge 20 lying transversely across an intermediate point in said tray 11. Body drainage ramp 12 is provided with a concave-contoured longitudinal body receiving depression or basin 13 occupying the center portion of said body supporting and drainage ramp 12 as illustrated in FIG. 1 and FIG. 2 of the Drawings herein which is adapted to receive and support the torso of an infant as illustrated in FIG. 2 of the Drawings.

In order to prevent the build up of soiled water or soap under the baby, concave body receiving depression 13 is provided with a longitudinally positioned drainage groove 14 through the center of said depression 13 which terminates and empties at the open end of body drainage ramp 12. In addition the bed of body receiving depression 13 in body supporting and drainage ramp 12 is provided with a plurality of non-slip friction holding strips 15—15 lying parallel to each other and positioned on either side of and transversely with respect to drainage groove 14 as illustrated in FIG. 1 and FIG. 3 of the Drawings herein. Friction providing strips 15—15 are analogous to the non-slip safety strips now marketed for use in bath tubs and on shower floors to provide bathers with a secure footing and prevent falls. If the surface of plastic tray 11 becomes slick after being coated with soap and water, the baby's torso would tend to slide downward producing a pull on the baby's neck and head which in turn creates panic. Both the slippage and the associated panic are prevented by providing the described friction strips 15—15 which maintain the infant in proper position on tray 11 without strain or insecurity.

At the opposite end of baby bathing tray 11 and on the other side of transverse ridge 20 there is provided at a longitudinally spaced apart distance from body support ramp 12 a head supporting and shampooing drainage ramp 16 which occupies almost one-third of the length of said baby bathing tray 11. Said head supporting and drainage ramp 16 inclines downwardly from transverse ridge 20 to the open end of tray 11 as illustrated in FIG. 1 and FIG. 2 of the Drawings. The left, right and upper sides of drainage ramp 16 are bounded by a generally U-shaped shallow vertical wall 17 defining the outer perimeter of three sides of said drainage ramp. The fourth side or open lower end of ramp 16 terminates and merges into the end portion of base perimeter structure 24. There is also provided on the floor of head supporting and shampooing drainage ramp 16 a plurality of parallel, spaced-apart ridge shaped run-off guides 18—18 positioned in parallel with respect to each other and positioned longitudinally with respect to the length of the tray.

If tray 11 is fabricated from a reasonably flexible low impact plastic or a medium hard rubber material to minimize danger of injury to the baby in cases of accidental collision with parts of the tray structure then problems arise from the buckling of the tray under the weight of the baby which in turn permits an accumulation of soiled water in depressions created by such buckling. Such buckling of tray 11 is prevented by fabricating said baby bathing tray 11 with a generally H shaped reinforcing structure 19 forming an elevated perimeter around three sides of each of the longitudinally spaced apart ramps together with an elevated transverse ridge 20 occupying the space between the upper ends of the two inclined spaced apart ramps. Ridge structure 20 supplies transverse strength to the structure and the elevated legs of H shaped perimeter structure 19 provides a measure of longitudinal strength. In addition ridge shaped run-off guides 18—18 also provide longitudinal buttressing support to transverse ridge 20 in addition to preventing pooling of water under the baby's head.

Additional longitudinal rigidity against buckling is also provided by means of drainage groove 14 which is positioned along the center of body receiving depression 13 in body supporting and drainage ramp 12. The pronounced ridge contouring of H shaped perimeter structure 19 together with height of transverse ridge 20 provides space on the under surface of tray 11, not shown, in which the manufacturer of the device may provide additional measures of both longitudinal and transverse bracing as necessary to prevent buckling of said tray.

Also note in FIG. 1 and FIG. 2 of the Drawings that in the center portion of transverse ridge structure 20 there is provided a concave neck receiving depression 21 and that said transverse ridge 20 forms the apex of a long obtuse triangular structure in which the baby's body lies on one side of ridge 20 and the baby's head lies on the opposite side of said ridge 20. This structure permits the baby's head to slope downward in one direction and the baby's body to slope downward in the opposite direction so that soapy water and shampoo fluids applied to either the body or the head can flow off in opposite directions without the danger of getting such fluids into the face and eyes of the infant.

On the left and right longitudinal sides of baby bathing tray 11 there are provided inwardly inclined side walls 22—22 rising from base 24 of the tray to enclose left and right sides to said tray and to provide bracing support to the outside edge of said H shaped perimeter structure 19. In each of said side wall structures 22—22 there is provided an appropriate hand hold means 23- which may be a handle or may take the form of shaped hand hold openings 23—23 cut into the surface of side wall structures 22—22. Said hand hold means 23—23 provide a convenient means by which tray 11, baby and all, may be lifted, carried, and repositioned to enable the mother to have better direct access to those parts of the baby that need bathing.

OPERATION

In a normal operation or use of the device contemplated by this Invention, the mother will place baby bathing tray 11 on a table, sink drain board, on the ground or some convenient and reasonably flat surface upon which the tray and baby will be adequately supported and still be in a position that makes the baby available for bathing. The baby is then laid on its back on the upper surface of tray 11 with the body of the baby cradled in concave body receiving depression 13 with the baby's neck set into concave neck receiving depression 21 and the baby's head hanging downward on head supporting and shampooing ramp 16 as illustrated in FIG. 1 of the Drawings. The baby is then bathed in the conventional manner employing any source of water but note again that since the baby does not lie in its own soiled water that the entire bathing operation can be accomplished with a single pitcher or container of water holding slightly less than a gallon of water. This feature of the device along with the compactness, easy storeability and portability of the device should make the Invention exceptionally useful and popular with campers and with parents who must travel with a baby.

ADVANTAGES OF THE INVENTION

In the foregoing description of the structure and operation of the Invention set forth herein, a number of advantages have been claimed for the apparatus and others will be readily apparent to persons skilled in the art. In summary, a primary advantage of the Invention is that it provides a baby bathing support tray that comfortably and securely supports the child in an open accessible position on any convenient and nearly flat surface for more efficient soaping, sponging and rinsing and in such circumstances and convenience as to leave both hands available for the bathing process and thereby make the bathing process more enjoyable for both the baby and the mother.

Another advantage of the Invention is that it produces a bathing tray provided with contoured body receiving basins and non-slip friction providing strips and of such structural arrangement as to reduce to a very minimum the danger of an infant being able to roll or slip off of said bathing tray thereby improving the mutual confidence and comfort of the mother and the baby.

Another advantage of the Invention is that by fabricating such improved baby bathing and shampooing tray from a semisoft or flexible form of plastic material that will minimize the danger of injury to the baby by accidental impact with parts of the tray.

Still another advantage of the Invention is that the recommended structure of said baby bathing tray makes it possible to bathe the baby in such position and circumstances that soap and shampoo solutions are drained away from the baby's face in opposite directions thereby reducing the danger of getting soap into the baby's eyes.

Still another advantage of the Invention is that it provides an effective baby bathing device in the form of a substantially flat unitary tray of sufficient compactness that it will be convenient to handle, store and use in a crowded apartment and in an automobile by auto travelling families.

A further advantage of the Invention is that it provides a baby bathing device that is so nearly analagous in structure to the already familiar baby carrying tray that the baby readily accepts it as a familiar environmental setting for the bathing process.

A still further advantage of the Invention is that provides a light weight compact and highly portable baby bathing tray that may be used on any convenient substantially flat surface such as a table, a sink drain board, the hood or trunk of an automobile or even on the open ground and that requires the application of such a small amount of water that campers or auto travellers can bathe a baby in the open with a single gallon container of water — without requiring access to conventional plumbing and water facilities. The Invention is such compact portability and efficiency that it can be stored in a suit case and used in a bus or airplane rest room, if needed.

A still further advantage of the Invention is that the recommended structure for said baby bathing tray, by leaving both of the opposite ends of the spaced apart drain ramps open, makes it possible to use the same baby bathing tray over a considerable period of time in spite of the rapid growth of the infant.

A still further advantage of the Invention is that its smooth finish and open unitary structure produce a baby bathing device that is easily kept clean and sanitary.

Although this specification describes but a single embodiment of the Invention with certain applications thereof, it should be understood that structural or material rearrangements of adequate or equivalent parts, substitutions of equivalent functional elements and other modifications in structure can be made and other applications devised without departing from the spirit and scope of my Invention. I therefore desire that the description and drawings herein be regarded as only an illustration of my Invention and that the Invention be regarded as limited only as set forth in the following claims, or as required by the prior art.

Having thus described my invention, I claim:

1. An improved portable baby bathing and shampooing tray adapted to rest on a substantially flat surface, including drain provisions, said tray comprising:

A. a base perimeter adapted to rest on a substantially flat surface;

B. an inclined body supporting and drainage ramp, said body supporting and drainage ramp
   1. occupying about two-thirds of the length of the tray,
   2. being inclined upwardly from its outside lower extremity to an elevated ridge lying transversely across the tray at an intermediate point in the length of the tray,
   3. having a longitudinal concave body receiving depression along the center of said body supporting and drainage ramp, and
   4. having a longitudinally positioned drainage groove positioned down the center of said concave body depressions;

C. a head supporting and shampooing drainage ramp longitudinally spaced apart from said body drainage ramp, said head supporting and shampooing drainage ramp
   1. occupying almost one-third of the length of said baby bathing tray,
   2. inclined downwardly from a transverse ridge lying across an intermediate point in the length of the tray to an open end of the tray,
   3. being bounded by a generally U shaped shallow vertical wall defining the outer perimeter of three sides of said head drainage ramp, and
   4. a plurality of water run off guides lying parallel with the length of said head drainage ramp to guide liquids to the open end of said head drainage ramp;

D. a generally H shaped structure forming an elevated perimeter around three sides of each of the longitudinally spaced ramps with an elevated transverse ridge occupying the space between the upper ends of the two inclined spaced apart ramps and a concave neck receiving depression being provided in the transverse ridge portion of said perimeter structure;

E. inwardly inclined side walls rising from the base of the tray to enclose the left and right longitudinal sides of said trays and supporting the outside edge of said H shaped perimeter structure; and F. hand hold carrying means comprising shaped openings being provided in each of the side walls of said improved baby bathing and shampooing tray.

* * * * *